United States Patent [19]

Rademacher

[11] 4,442,653

[45] Apr. 17, 1984

[54] MACHINE FOR FILLING BOTTLES AND CANS

[75] Inventor: Friedrich Rademacher, Kamen-Suedkamen, Fed. Rep. of Germany

[73] Assignee: Holstein & Kappert GmbH, Dortmund, Fed. Rep. of Germany

[21] Appl. No.: 303,713

[22] Filed: Sep. 18, 1981

[30] Foreign Application Priority Data

Nov. 27, 1980 [DE] Fed. Rep. of Germany ..... 3044597

[51] Int. Cl.[3] ..... B65B 43/52

[52] U.S. Cl. ..... 53/266 R; 53/282; 198/636

[58] Field of Search ..... 53/282, 201, 266 R; 198/636, 717, 728, 631, 633

[56] References Cited

U.S. PATENT DOCUMENTS

| | | | |
|---|---|---|---|
| 2,699,281 | 1/1955 | Duke | 53/282 |
| 2,978,091 | 4/1961 | Henthorn | 198/636 X |
| 3,378,129 | 4/1968 | Mencacci | 53/282 X |
| 3,797,195 | 3/1974 | Brink et al. | 53/282 X |
| 4,109,446 | 8/1978 | Krohn et al. | 53/282 |

*Primary Examiner*—Horace M. Culver

*Attorney, Agent, or Firm*—Michael J. Striker

[57] ABSTRACT

In a bottle- and can-filling machine the bottles after filling are fed from a star wheel directly to a capping carrousel and cans after filling are fed from the star wheel via a feed device along a feed path to a closing machine. This feed device is a feed chain extending from the closing machine right up to the star wheel of the filling machine and lying to the side of the center of the can path at the star wheel. Normally the chain lies to the outside of the center of this path at the star wheel and has fingers engageable behind the cans.

3 Claims, 1 Drawing Figure

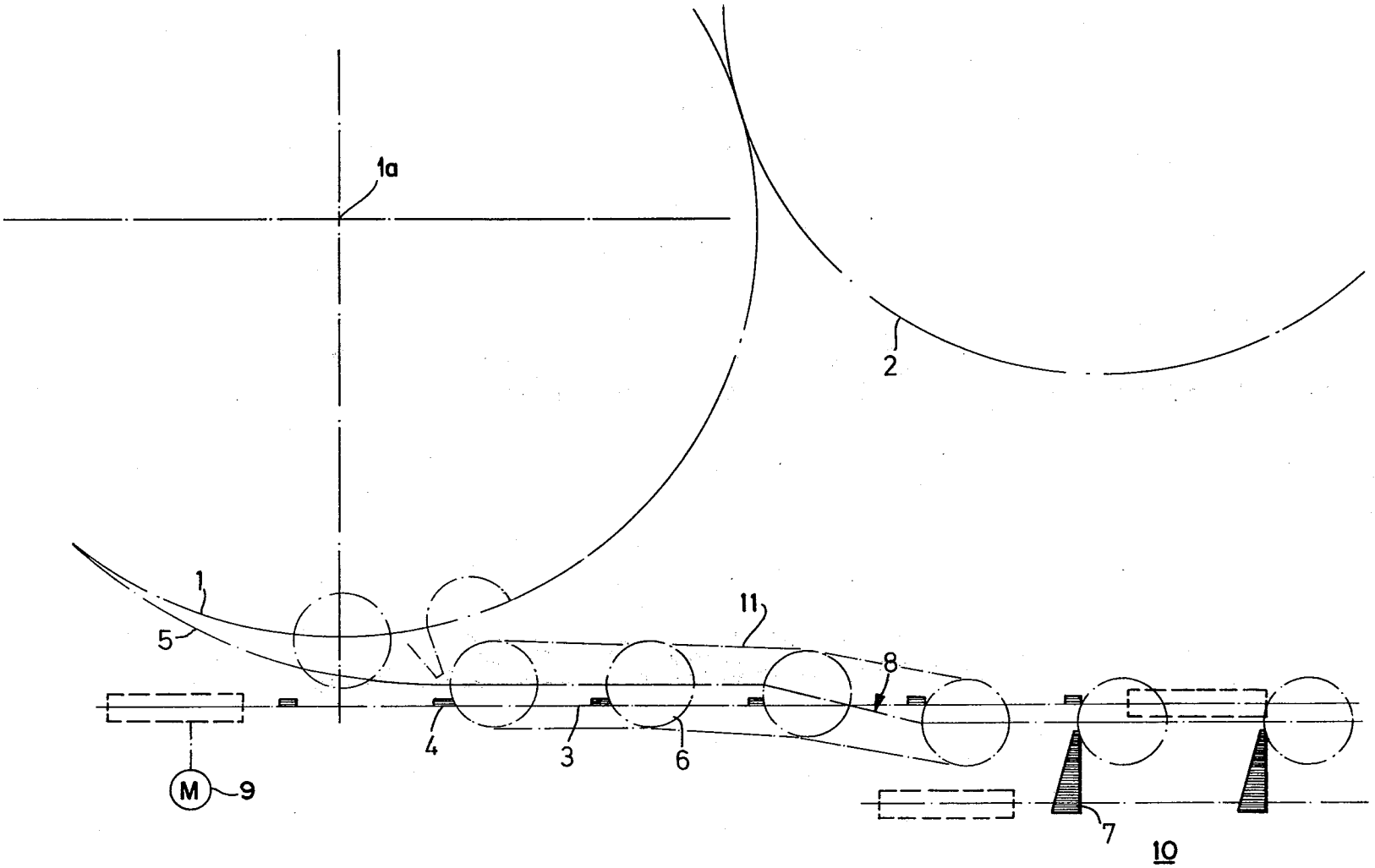
1a
2
1
5
4
3
6
11
8
7
10
9
M

MACHINE FOR FILLING BOTTLES AND CANS

FIELD OF THE INVENTION

The present invention relates to a machine that can fill bottles and cans, that is one that can be switched over from the automatic filling and capping of bottles to the automatic filling and closing of cans.

BACKGROUND OF THE INVENTION

A standard bottle- and can-filling machine is seen in German Utility Model No. 7,012,174, whose entire disclosure is herewith incorporated by reference. Such a machine moves the bottles after filling them by means of a star wheel which feeds them directly to a capping carrousel. Filled cans are fed from this star wheel to a feed auger which passes them to a conveyor chain that passed them in turn to a closing machine.

The main problems with such a machine is that the feed auger for the cans that is arranged upstream of the feed chain for the bottles must be moved out of the way when switching from a run of cans to a run of bottles. The feed auger otherwise is in the way of the bottles going to the capping machine.

OBJECTS OF THE INVENTION

It is therefore an object of the present invention to provide an improved can and bottle machine.

Another object is the provision of such a machine which can easily be switched over between cans and bottles.

SUMMARY OF THE INVENTION

These objects are attained according to the instant invention in a bottle- and can-filling machine of the above-described general type, that is wherein the bottles after filling are fed from a star wheel directly to a capping carrousel and wherein cans after filling are fed from the star wheel via a feed device along a feed path to a closing machine. According to the instant invention, the feed device is a feed chain extending from the closing machine right up to the star wheel of the filling machine and lying to the side of the center of the can path at the star wheel. Normally the chain lies to the outside of the center of this path at the star wheel and has fingers engageable behind the cans.

Thus it is possible with the machine according to this invention to switch over from bottles to cans, or vice-versa, without having to perform substantial work on the machine.

According to another feature of this invention the chain crosses the can path downstream of the star wheel and lies outside the center of this path at the closing machine.

DESCRIPTION OF THE DRAWING

The above and other features and advantages will become more readily apparent from the following, reference being made to the accompanying drawing whose sole FIGURE is a laregly schematic representation of the instant invention.

SPECIFIC DESCRIPTION

As shown in the drawing a star wheel 1 can feed bottles or cans from a not-illustrated filling machine of the type described in the above-cited German Utility Model directly to a carrousel-type bottle-capping machine 2 or along a path defined by guides indicated schematically at 11 and whose center is indicated at 5 to a can-closing machine, also of the type described in this Utility Model.

According to this invention when cans 6 are being processed, they are transported between the star wheel 1 to the machine 10 by means of a chain 3 having fingers 4 that engage behind the cans 6 laterally offset to the center of the feed path 5 on one side of the cams 6 in an upstream portion of the feed path 5, i.e. on the right side of the cans 6, as shown in the FIGURE. This chain 3 which extends in a straight line between the can closing machine and the star wheel 1 and is guided about spaced horizontally extending axes (not shown) is advanced by a motor indicated schematically at 9 and lies at the star wheel 1 outside its center 1*a* of rotation so that it does not interfere with bottles that are being advanced by this wheel 1 to the capper 2.

The guides 11 deflect the path at 8 at the machine 10 so that the center of the path 6 crosses the straight run of the chain 3 which, therefore, again lies outside the path at the machine 10 i.e., laterally offset to the center of the path 5 on the other side of the cans 6 in a downstream portion of the feed path 5, that is the left side of the cans as shown in the FIGURE, so that pusher fingers 7 again can engage behind the cans 6 without interfering with the chain 3 and guide the cans 6 to a can closing machine. Due to the straight line extension of the chain 3 and the deflection of the guide 11 at 8, the different positions of the fingers 4 with respect to the cans is obtained.

Thus the system according to the instant invention completely does away with the auger of the prior-art machines. Changeover from cans to bottles, therefore, is a relatively simple task that does not necessitate unbolting or unclamping pieces of the machine and moving them about.

What is claimed as new and desired to be protected by Letters Patent is set forth in the appended claims.

1. An arrangement for guiding containers, like bottles and cans between a filling machine and a respectively associated closing machine, wherein the bottles of the filling are fed from a starwheel directly to the associated closing machine along a feed path, the arrangement comprising:

an endless feed chain for guiding the cans along a further feed path to the other associated closing machine, the feed chain extending between the starwheel and the other closing machine around horizontally extending axes spaced from each other and being arranged laterally to the feed path of the bottles so as to cooperate with each can fed from the filling machine in case the cans are to be filled and not to intefere with the bottles fed from the filling machine in case the bottles are to be filled, wherein the feed chain includes a plurality of fingers engageable behind the cans in such a manner that in direction of the further feed path the fingers of the feed chain are arranged to engage in an upstream position behind one side of the cans at a laterally offset position to the center line of the further feed path and in a downstream direction to engage behind the other side of the cans at a laterally offset position to the center line of the further feed path.

2. An arrangement as defined in claim 1, wherein the feed chain crosses the center line of the further feed path between the upstream portion and the downstream portion so as to provide the different positions of the fingers with respect to the cans along the further feed path of the latter.

3. An arrangement as defined in claim 1; and further comprising a second plurality of fingers cooperating with the fingers of the feed chain in such a manner that the second plurality of fingers engage behind the cans in the downstream portion without interfering with the fingers of the feed chain so as to guide the cans to the closing machine.

* * * * *